US005853939A

United States Patent [19]

Yanagibori et al.

[11] Patent Number: 5,853,939

[45] Date of Patent: Dec. 29, 1998

[54] TONER FOR ELECTROSTATIC IMAGE DEVELOPMENT

[75] Inventors: Akihiko Yanagibori, Chigasaki; Hitoshi Ono; Noriaki Takahashi, both of Yokohama, all of Japan

[73] Assignee: Mitsubishi Chemical Corporation, Tokyo, Japan

[21] Appl. No.: 684,479

[22] Filed: Jul. 19, 1996

[30] Foreign Application Priority Data

| | | | |
|---|---|---|---|
| Jul. 21, 1995 | [JP] | Japan | 7-185455 |
| Jul. 21, 1995 | [JP] | Japan | 7-185457 |
| Aug. 21, 1995 | [JP] | Japan | 7-211761 |

[51] Int. Cl.[6] ..... G03G 9/00

[52] U.S. Cl. ..... 430/110; 430/109; 430/111; 430/904

[58] Field of Search ..... 430/110, 109, 430/111, 904

[56] References Cited

U.S. PATENT DOCUMENTS

| | | | |
|---|---|---|---|
| 4,939,060 | 7/1990 | Tomiyama et al. | 430/106.6 |
| 4,966,829 | 10/1990 | Yasuda et al. | 430/109 |
| 5,510,222 | 4/1996 | Inaba et al. | 430/109 |
| 5,595,849 | 1/1997 | Niinae | 430/106.6 |
| 5,597,674 | 1/1997 | Suzuki et al. | 430/109 |
| 5,635,325 | 6/1997 | Inaba et al. | 430/106 |

FOREIGN PATENT DOCUMENTS

| | | | |
|---|---|---|---|
| 0 103 967 | 3/1984 | European Pat. Off. . | |
| 0 619 527 | 10/1994 | European Pat. Off. . | |
| 0627669 | 12/1994 | European Pat. Off. | 430/109 |
| 0 658 819 | 6/1995 | European Pat. Off. . | |
| 0 686 880 | 12/1995 | European Pat. Off. . | |
| 50-81342 | 7/1975 | Japan . | |
| 59-157655 | 9/1984 | Japan . | |
| 59-164560 | 9/1984 | Japan . | |
| 59-228661 | 12/1984 | Japan . | |

*Primary Examiner*—Nam Nguyen
*Assistant Examiner*—Steven H. VerSteeg
*Attorney, Agent, or Firm*—Oblon, Spivak, McClelland, Maier & Neustadt, P.C.

[57] ABSTRACT

The present invention relates to a toner for electrostatic image development comprising:

a lubricant having a DSC determined endothermic peak at 50°–130° C., with the half value width of said endothermic peak being not more than 15° C., and represented by the formula (I):

$$R^1-\underset{\underset{O}{\|}}{C}-R^2 \qquad (I)$$

wherein $R^1$ represents an alkyl or alkoxyl group having 10 or more carbon atoms, and $R^2$ represents an alkyl group having 10 or more carbon atoms or a group represented by —X—COOR$^3$ wherein X represents an alkylene group and $R^3$ represents an alkyl group having 10 or more carbon atoms;

a binder resin comprising a styrene-based resin in which tetrahydrofuran soluble matter has the weight-average molecular weight of not less than 50,000, and has one or more peaks of molecular weight in the range of not more than $5\times10^4$ and the range of $1\times10^5$ to $1\times10^7$ respectively, on the gel permeation chromatogram; and a coloring agent.

13 Claims, No Drawings

TONER FOR ELECTROSTATIC IMAGE DEVELOPMENT

BACKGROUND OF THE INVENTION

The present invention relates to a toner for electrostatic image development. More particularly, it relates to a toner for electrostatic image development containing a specific lubricant, and having excellent fixation characteristics (low-temperature fixation property and high fixation strength), anti-off-setting property and anti-blocking property.

It is required for a toner for electrostatic image development that it can be quickly fixed on a transfer material and it must not be to occur "off-setting" phenomenon, that is, the toner transfers on a fixing roller surface and then, a transfer material is stained by the said toner on the fixing roller. Further, it must not be to occur blocking during either storage or transport thereof. The toner suffered blocking is badly deteriorated in fluidity and charging characteristics and as a result, the said toner does not have an ability of developer. Therefore, the binder resin used as a main constituent of the toner is required to have a delicate hardness and heat fusing characteristics. The toner obtained by milling and classifying a binder resin incorporated with a coloring agent and other substances is required to produce little fine powder under mechanical impact of stirring in the developing apparatus and show good fluidity without causing aggregation of the toner itself. It is also required that the toner is quickly fused at low temperatures in fixating step, and also the fused toner shows aggregation property when fused. It is very difficult to design a binder resin which can satisfy all of these requirements. Since especially, the fixation characteristic, and the anti-off-setting and anti-blocking property are the antagonistic matters to each other, it is hard to improve both of them simultaneously.

Many proposals have been made regarding the molecular weight and the molecular weight distribution of the polymers used as binder resin. For example, a toner containing 50–95% by weight of a low-temperature softening, high-fluidity resin having a number-average molecular weight of 1,000–4,000 has been proposed (Japanese Patent Application Laid-Open (KOKAI) No. 59-107360), but this toner still involves the problems of anti-off-setting and anti-blocking properties. Also, Japanese Patent Application Laid-Open (KOKAI) No. 63-32180 proposes a use of styrene copolymer-based binder resin having at least one maximum value of molecular weight in each of the regions $10^3$–$8\times10^4$ and $10^5$–$2\times10^6$.

However, the toners disclosed in the above patents are still incapable of satisfying the requirements for improving both of said antagonistic properties, namely fixation characteristics (especially fixation strength) on the transfer material and anti-blocking property, simultaneously. According to these proposals, since it is necessary for improving the fixation characteristics to increase the content of the low-molecular weight component in binder resin, the toner deteriorate in the anti-blocking property. On the other hand, for improving the anti-blocking property sufficiently, it is necessary to increase the content of the high-molecular weight component in the binder resin and when increasing the content thereof, the toner deteriorates in the fixation characteristics.

As a result of the present inventors' earnest studies for overcoming the above problems, it has been found that a toner for electrostatic image development comprising a specific lubricant, a binder resin comprising a styrene-based resin having a specific molecular weight distribution and a coloring agent, is excellent in any of fixation characteristics (low-temperature fixation property and fixation strength), anti-off-setting property and anti-blocking property. The present invention is based on this finding.

SUMMARY OF THE INVENTION

The object of the present invention is to provide a toner for electrostatic image development which is excellent in fixation characteristics (low-temperature fixation property and fixation strength), anti-off-setting property and anti-blocking property.

To accomplish the aim, in an aspect of the present invention, there is provided a toner for electrostatic image development comprising:

a lubricant having a DSC determined endothermic peak at 50°–130° C., with the half value width of said endothermic peak being not more than 15° C., and represented by the formula (I):

$$R^1-\underset{\underset{O}{\|}}{C}-R^2 \qquad (I)$$

wherein $R^1$ represents an alkyl or alkoxyl group having 10 or more carbon atoms, and $R^2$ represents an alkyl group having 10 or more carbon atoms or a group represented by —X—COOR$^3$ wherein X represents an alkylene group and $R^3$ represents an alkyl group having 10 or more carbon atoms;

a binder resin comprising a styrene-based resin in which tetrahydrofuran soluble matter has the weight-average molecular weight of not less than 50,000, and has one or more peaks of molecular weight in the range of not more than $5\times10^4$ and the range of $1\times10^5$ to $1\times10^7$ respectively, on the gel permeation chromatogram; and a coloring agent.

DETAILED DESCRIPTION OF THE INVENTION

A detailed explanation of the present invention is given below.

The lubricant used in the present invention needs to have an endothermic peak in the temperature range of 50°–130° C. as determined by a differential scanning calorimeter (DSC). If the endothermic peak is less than 50° C., the anti-blocking property may be deteriorated. If the endothermic peak is more than 130° C., the fixation characteristics may not be improved. The DSC determined endothermic peak is preferably present in the temperature range of 60°–120° C., more preferably 65°–90° C. It is also necessary that the half value width of the endothermic peak is not more than 15° C. Here, the "half value width" is defined as an endothermic peak width at the half height of the said peak. If the half value width of the endothermic peak is more than 15° C., the toner may deteriorate in anti-blocking property. The said half value width is more preferably not more than 10° C. In the present invention, the endothermic peak was measured by using DSC 7000 (mfd. by Shinkuu Riko Co., Ltd.) at a heating rate of 10° C./min.

The lubricant used in the present invention needs to meet the above conditions and to have a molecular structure represented by the following formula (I):

$$R^1-\underset{\underset{O}{\|}}{C}-R^2 \qquad (I)$$

wherein $R^1$ represents an alkyl or alkoxyl group having 10 or more carbon atoms, and $R^2$ represents an alkyl group having 10 or more carbon atoms or a group represented by —X—COOR$^3$ wherein X represents an alkylene group and R$^3$ represents an alkyl group having 10 or more carbon atoms.

In the formula (I), R$^1$ represents an alkyl or alkoxyl group, each group having 10 or more, preferably 16 or more, more preferably 20 or more carbon atoms. It is preferable that the upper limit of the number of the carbon atoms of R$^1$ is 40. R$^2$ represents —X—COOR$^3$ wherein X is preferably a linear alkylene group represented by the formula:

$$\text{-}(CH_2)_n\text{-}$$

wherein n is a number of 6 or greater, preferably 6–16, and R$^3$ is preferably an alkyl group having 20 or more carbon atoms and it is preferable that the upper limit of the number of the carbon atoms of R$^3$ is 40; or R$^2$ represents an alkyl group having 10 or more, preferably 16 or more, more preferably 20 or more carbon atoms and it is preferable that the upper limit of the number of the carbon atoms of R$^2$ is 40. When R$^2$ is —X—COOR$^3$, R$^1$ is preferably an alkoxyl group, that is, the formula (I) represents diester. Examples of the lubricants which meet the above conditions, include aliphatic ketones such as di-n-decyl ketone, di-n-dodecyl ketone, di-n-stearyl ketone, di-n-icosyl ketone, di-n-behenyl ketone and di-n-tetracosyl ketone; fatty acid diesters such as didodecyl sebacate, distearyl sebacate and dibehenyl sebacate; and fatty acid monoesters such as stearyl laurate, behenyl laurate, stearyl stearate, behenyl stearate, myricyl stearate, stearyl behenate, behenyl behenate, miricyl behenate, stearyl lignocerate, behenyl lignocerate and miricyl lignocerate. Mixtures of these lubricants can also be preferably used, but in this case, the half value width of the DSC determined endothermic peak must be not more than 15° C. Those lubricants in which the total number of carbon atoms in the molecule is 36 to 70 are especially preferred. Of those lubricants, aliphatic ketones are most preferred. Two or more kinds of the said lubricants may be used in combination.

The lubricant of the present invention is added in an amount of usually 0.5–30 parts by weight, preferably 1–15 parts weight, more preferably 2–10 parts by weight based on 100 parts by weight of the binder resin. The lubricant is not chemically bound, for example, not grafted to the binder resin and the lubricant is merely mixed therewith. When the lubricant content is less than 0.5 part by weight based on 100 parts by weight of the binder resin, the effect of lubricant may be insufficient, and when the content exceeds 30 parts by weight based on 100 parts by weight of the binder resin, the toner may deteriorate in anti-blocking property.

The molecular weight of the lubricant used in the present invention is preferably 200 to 1000, more preferably 250 to 900, still more preferably 500 to 800. Either when the molecular weight of the lubricant is less than the above-defined range or when it is more than the said range, it is hard to meet the requirement for improving both of fixation characteristics and anti-blocking property.

The binder resin used in the present invention is styrene-based resin in which the resin contains 30% by weight or more of the structural units of styrene or styrene derivatives. Especially, the styrene homopolymer, styrene-acrylic ester copolymers, styrene-methacrylic ester copolymers or mixtures thereof are preferred. The tetrahydrofuran soluble matter of the styrene-based resin has the weight-average molecular weight of not less than 50,000, and has one or more peaks of molecular weight in the range of not more than $5\times10^4$, preferably not more than $2\times10^4$, more preferably not more than $1\times10^4$, and in the range of $1\times10^5$ to $1\times10^7$ respectively, on the gel permeation chromatogram. By a synergistic effect of use of a lubricant such as mentioned above in combination with said binder resin, fixation characteristics of the toner become remarkably excellent.

In the present invention, it is preferred that the lubricant is in a state of being uniformly dissolved or dispersed in the binder resin.

The amount of the tetrahydrofuran insoluble matter in the binder resin of the present invention is not greater than 70% by weight, preferably not greater than 40% by weight, more preferably not greater than 25% by weight based on the weight of the binder resin.

The term "tetrahydrofuran insoluble matter" used in the present invention means the matter which can not be passed through the filter when a binder resin (or the binder resin in the toner) is added to tetrahydrofuran in an amount of 1% by weight and the solution is stirred vigorously at 25° C. for 8 hours and passed through a filter.

Known methods can be employed for determining the weight-average molecular weight and the peaks of molecular weight of the solubles obtained by the above method. For example, an appropriate method in ordinary gel permeation chromatography described below can be employed:

1. Measuring conditions

Temperature: 40° C.

Solvent: tetrahydrofuran

Flow rate: 0.5 ml/min

Specimen concentration: 0.1 wt %

Amount of specimen injected: 100 $\mu$l

2. Column

A combination of plural pieces of commercially available polystyrene gel columns is used for precise determination of the molecular weight region of $1\times10^3$~$2\times10^6$.

For determination in the present invention, GMHXL (2 columns, 30 cm) mfd. by Tosoh Corporation was used.

3. Calibration curve

Standard polystyrenes are used for drawing up the calibration curve. As standard polystyrenes, there can be used those having a molecular weight of, for example, $6\times10^2$, $2.8\times10^3$, $6.2\times10^3$, $1.03\times10^4$, $1.67\times10^4$, $4.39\times10^4$, $1.02\times10^5$, $1.86\times10^5$, $2.2\times10^5$, $7.75\times10^5$ or $1.26\times10^6$, which are available from, for example, Pressure Chemical Co., or Tosoh Corporation. It is advisable to use at least about 10 samples of standard polystyrene.

4. Detector

A refractive index (RI) detector is used.

The binder resin used in the present invention is preferably of a glass transition temperature (Tg) in the range of 50°–70° C., more preferably 55°–65° C.

The relation between said binder resin and said lubricant in the present invention is described below.

It is necessary that the lubricant used in the present invention has its DSC determined endothermic peak in the temperature range of 50°–130° C. This DSC determined endothermic peak denotes the melting point of the lubricant.

The lubricant used in the present invention is a monomer (compound) having a definite melting point (mp) and is neither a polymer nor an oligomer. The melting point (mp) of the lubricant is preferably defined as follows in relation to the glass transition temperature (Tg) of said binder: $Tg \leqq mp \leqq Tg+50$[°C.]. When the melting point (mp) is less than the glass transition temperature (Tg), the toner deteriorates in anti-blocking property, and when the melting point (mp) is more than the temperature of Tg+50° C., the effect of improving the fixation characteristics is scanty. A preferable relation between Tg and mp is $Tg+5 \leqq mp \leqq Tg+40$[°C.].

By combined use of a binder resin having a defined glass transition temperature (Tg) and a lubricant (not a polymer) having a defined melting point (mp), a synergistic effect in improving the fixation characteristics as well as the anti-off-setting and anti-blocking property in well balance is attained.

As coloring agent, there can be used all of those known in the art, which include, for example, carbon black, nigrosine, benzidine yellow, quinacridone, rhodamine B and phthalocyanine blue.

The toner of the present invention may further contain various other substances which are normally added upon the preparation of toner.

The toner according to the present invention can be used for both dry type mono-component developer and dual-component developer. The magnetic substances usable for the mono-component developer include the ferromagnetic alloys or compound of iron, cobalt, nickel, etc., such as ferrite and magnetite; the alloys which, although containing no ferromagnetic element, can be made ferromagnetic by a proper heat treatment, for example Heusler's alloys containing manganese and copper, such as manganese-copper-aluminum and manganese-copper-tin alloys; chrome dioxide, and the like. The magnetic substance is uniformly dispersed in the binder resin in the form of fine powder with an average particle size of 0.3–30 $\mu$m. The content of the magnetic substance in the toner composition is preferably 20–70 parts by weight, more preferably 40–70 parts by weight based on 100 parts by weight of the binder resin.

Control of electric charge of the toner may be performed by the binder resin and/or the coloring agent itself, but if necessary a charge controlling agent may also be used. As positive charge controlling agent, quaternary ammonium salt, basic or electron-donative organic substances or the like can be used, and as negative charge controlling agent, metal chelates, metal containing dyes, acidic or electron attractive organic substances or the like can be used. It is also possible to use the inorganic particles such as metal oxide particles and the inorganic substances having their particle surfaces treated with said organic substances. Such a charge controlling agent may be directly mixed in the binder resin or may be attached to the toner particle surfaces. The amount of the charge controlling agent to be added may be properly decided by taking into consideration various factors such as charging characteristics of the binder resin used, preparation conditions including the amount of the coloring agent added and the means of dispersion, charging characteristics of other additives, etc., but it is preferably 0.1–10 parts by weight based on 100 parts by weight of the binder resin.

Further, the electrical properties of the toner can be controlled by adding an appropriate substance or substances such as solid electrolyte; polymeric electrolyte; charge transfer complex; conductors or semiconductors such as metal oxides (e.g. tin oxide); ferroelectrics; and magnetic substances. It is also possible to add proper auxiliary agents including various types of plasticizer and release agent such as low-molecular weight polyalkylene, etc., in the toner for the purpose of adjusting the thermal and physical properties of the toner. The amount of such auxiliary agents to be added is preferably 0.1–10 parts by weight based on 100 parts by weight of the binder resin.

The surfaces of the toner particles may be further coated with fine particles of $TiO_2$, $Al_2O_3$, $SiO_2$ or the like to improve fluidity and anti-aggregation of the toner. The amount of such a compound added is preferably 0.1–10 parts by weight based on 100 parts by weight of the binder resin.

The toner of the present invention may be produced through the step of dissolving or dispersing a binder resin and a lubricant in an organic solvent. A toner containing the resin composition obtained through the said step (a composition containing a binder resin and a lubricant as main constituents, hereinafter referred to simply as 'resin composition') is more excellent than a toner obtained by merely kneading a binder resin and a lubricant, especially in fixation characteristics, anti-blocking property, stability and reproducibility. The step of dissolving or dispersing a binder resin and a lubricant in an organic solvent is not specifically conditioned. Typically, after a binder resin and a lubricant have been dissolved or dispersed with stirring and mixing in an organic solvent which is capable of dissolving or dispersing said both components, the solvent is separated away by suitable means such as evaporation.

All the organic solvents which are capable of dissolving or dispersing both of binder resin and lubricant can be used in the present invention, but those which can be easily evaporated away are preferably used. Examples of such organic solvents include hydrocarbons such as toluene, xylene and styrene; halogenated hydrocarbons such as trichloroethane and chlorobenzene, alcohols such as propanol, butanol, hexanol and benzyl alcohol; phenols such as phenol and cresol; ethers such as dioxane, tetrahydrofuran, diethoxyethane, diethylene glycol dimethyl ether, diethylene glycol diethyl ether, propylene glycol ethylether, propylene glycol methyl ether, and propylene glycol monomethyl ether acetate; ketones such as acetone, methyl ethyl ketone, methyl butyl ketone, isophorone and cyclohexanone; acids such as acetic acid and propionic acid; esters such as ethyl acetate, butyl acetate, methyl propionate and propylene carbonate.

After the binder resin and the lubricant have been dissolved in an organic solvent, the solution may be dropped into a liquid which does not dissolve the binder resin (non-solvent liquid), such as water and lower alcohols, to precipitate the resin composition and separate the solvent. In this case, a solvent which is readily miscible with the non-solvent liquid is preferably used as the organic solvent.

The lubricant may be dissolved or dispersed in the course of polymerization of the binder resin. For instance, both binder resin and lubricant may be dissolved or dispersed in a styrene monomer (a monomer solution) supposed to be a solvent, and then bulk or suspension polymerization of styrene monomer may be carried out to obtain a resin composition. A monomer such as a (meth)acrylic ester may be added into a styrene monomer having a lubricant dissolved therein for copolymerizing them. In case of performing solution polymerization in the binder resin synthesis step, a method is also preferable in which said lubricant is dissolved or dispersed in a solvent containing a monomer (a monomer solution).

In either case, the lubricant causes no reaction such as grafting with the binder resin. A method is especially preferred in which a lubricant is added to a solution wherein a binder resin has been dissolved, and after the lubricant has been dispersed or dissolved in the solution, the solvent is evaporated away under reduced pressure and the resultant product is roughly crushed to obtain particles of a resin composition.

Further various conventional methods can be applied for producing the toner of the present invention. The following process can be exemplified. First, a binder resin, a coloring agent, a lubricant (which may be omitted in case where it has already been blended in the binder resin) and if necessary, additives such as a charge controlling agent are uniformly dispersed by a suitable mixer such as ball mill, V type mixer, S type mixer, Henschel mixer, etc. The dispersion is melt kneaded by a kneader such as double-arm kneader, press kneader, etc., the resulting mixture is crushed by suitable means such as hammer mill, jet mill, ball mill, etc., and the produced powder is classified by an air classifier or like means. The particle size of the toner is usually 5 to 20 $\mu$m. The thus obtained toner, if containing no magnetic substance, is mixed with a carrier to form an electrophotographic developer and used for conventional electrophotocopying. As carrier, there can be used the known magnetic substances such as iron powder, ferrite, etc., or magnetic substances coated on the surface by resin, in an amount of preferably 10 to 100 parts by weight based on one part by weight of the toner.

In cases where the toner of the present invention is used for a dual-component developer, preferably ferrite or magnetite is used as carrier and a quaternary ammonium salt is further added to the toner comprising a binder resin, a coloring agent and a lubricant.

The quaternary ammonium salts usable preferably in the present invention include the compounds represented by the following formulae (II) to (VIII):

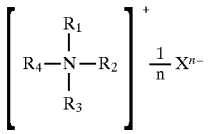

acyclic quaternary ammonium salts wherein $R_1$, $R_2$, $R_3$ and $R_4$ are each be identical or different and represent independently a substituted or unsubstituted aromatic carbocyclic group, a substituted or unsubstituted aromatic heterocyclic group, or a substituted or unsubstituted aliphatic hydrocarbon group; $X^{n-}$ represents an anion; n is a natural number (preferably an integer of 1 to 4); and the carbon number of each of $R_1$–$R_4$ is preferably 1 to 22.

(III)

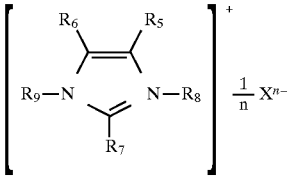

imidazolium salts wherein $R_5$ and $R_6$ represent independently hydrogen or a substituted or unsubstituted hydrocarbon group, or $R_5$ and $R_6$ may be combined with each other to form a substituted or unsubstituted aromatic ring; $R_7$ represents hydrogen or a substituted or unsubstituted hydrocarbon group; $R_8$ and $R_9$ represent independently a substituted or unsubstituted hydrocarbon group; $X^{n-}$ represents an anion; n is a natural number (preferably an integer of 1 to 4); when $R_5$, $R_6$ and $R_7$ are each a hydrocarbon group, its carbon number is preferably 22 or less, and the carbon number of $R_8$ and $R_9$ is preferably 8 or less respectively.

(IV)

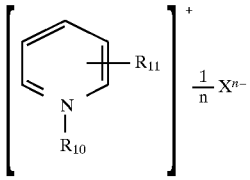

pyridinium salts wherein $R_{10}$ and $R_{11}$ are identical or different and represent independently a substituted or unsubstituted aromatic carbocyclic group, a substituted or unsubstituted aromatic heterocyclic group, a hydrogen atom (excepting $R_{10}$) or a substituted or unsubstituted aliphatic hydrocarbon group; $X^{n-}$ represents an anion; n is a natural number (preferably an integer of 1 to 4); and the carbon number of $R_{10}$ and $R_{11}$ is preferably 22 or less.

(V)

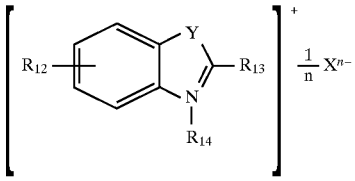

3H-indolium salts
(including oxa- or thia-3H-indolium salts)

wherein $R_{12}$, $R_{13}$ and $R_{14}$ are identical or different and represent independently a substituted or unsubstituted aromatic carbocyclic group, a substituted or unsubstituted aromatic heterocyclic group, a hydrogen atom (excepting $R_{14}$) or a substituted or unsubstituted aliphatic hydrocarbon group; Y represents C, O or S atom (in case where Y is C atom, it can have a substituent); $X^{n-}$ represents an anion; n is a natural number (preferably an integer of 1 to 4); and the carbon number of $R_{12}$ and $R_{13}$ is preferably 22 or less respectively.

(VI)

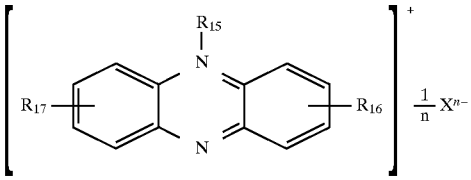

phenadinium salts wherein $R_{15}$, $R_{16}$ and $R_{17}$ are identical or different and represent independently a substituted or unsubstituted aromatic carbocyclic group, a substituted or unsubstituted aromatic heterocyclic group, a hydrogen atom (excepting $R_{15}$) or a substituted or unsubstituted aliphatic hydrocarbon group; $X^{n-}$ represents an anion; n is a natural number (preferably an integer of 1 to 4); and the carbon number of $R_{15}$, $R_{16}$ and $R_{17}$ is preferably 22 or less.

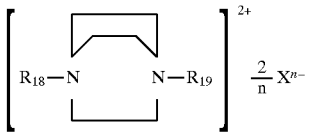

(VII)

triethylenebisammonium salts wherein $R_{18}$ and $R_{19}$ are identical or different and represent independently a substituted or unsubstituted aromatic carbocyclic group, a substituted or unsubstituted aromatic heterocyclic group, or a substituted or unsubstituted aliphatic hydrocarbon group; $X^{n-}$ represents an anion; n is a natural number (preferably an integer of 1 to 4); and the carbon number of $R_{18}$ and $R_{19}$ is preferably 22 or less respectively.

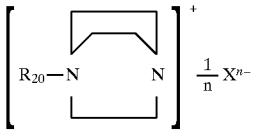

(VIII)

nitrilotriethylammonium salts wherein $R_{20}$ represents a substituted or unsubstituted aromatic carbocyclic group, a substituted or unsubstituted aromatic heterocyclic group, or a substituted or unsubstituted aliphatic hydrocarbon group; $X^{n-}$ represents an anion; n is a natural number (preferably an integer of 1 to 4); and the carbon number of $R_{20}$ is preferably 22 or less respectively.

Examples of the substituents which $R_1$ to $R_{20}$ and the aromatic ring formed by $R_5$ and $R_6$ may have are an alkyl group (exclusive of substitution for alkyl group), an aryl group, an aralkyl group, a hydroxyl group, an amino group, a halogen group and a heterocyclic residues. Also, $R_1$ to $R_{20}$ and the aromatic ring formed by $R_5$ and $R_6$ may have, a substituent such as alkyl group, aryl group, aralkyl group or heterocyclic residue through ether, thioether or amide linkage.

As anions in quaternary ammonium salts, there can be used various known ones, including but not limited to halogen ions such as chloride ion and bromide ion; organosulfonic acid ions such as methanesulfonic acid ion, ethanesulfonic acid ion, propanesulfonic acid ion, propanedisulfonic acid ion, propanetrisulfonic acid ion, benzenesulfonic acid ion, benzenedisulfonic acid ion, benzenetrisulfonic acid ion, naphthalenesulfonic acid ion, naphthalenedisulfonic acid ion, naphthalenetrisulfonic acid ion and quinolinesulfonic acid ion; substituted organosulfonic acid ions such as methyl-substituted organosulfonic acid ion, ethyl-substituted organosulfonic acid ion, propyl-substituted organosulfonic acid ion, hydroxy-substituted organosulfonic acid ion and anilino- substituted organosulfonic acid ion; isopolyacid ions such as dimolybdic acid ion, tetramolybdic acid ion, hexamolybdic acid ion and octamolybdic acid ion; and heteropolyacid ions such as tungstophosphoric acid ion. Of these anions, halogen ions, organosulfonic acid ions and substituted organosulfonic acid ions are preferred.

Among the compounds represented by the formulae (II) to (VIII), the noncyclic quaternary ammonium salts are preferred and examples thereof include but are not limited to the followings.

Exemplary compounds

| Compound No. | R | X |
|---|---|---|
| (1) | $R_1 = R_2 = C_{14}H_{29}$<br>$R_3 = R_4 = CH_3$ | $\frac{1}{4}(Mo_8O_{26})^{4-}$ |
| (2) | $R_1 = R_2 = C_{16}H_{33}$<br>$R_3 = R_4 = CH_3$ | $\frac{1}{4}(Mo_8O_{26})^{4-}$ |
| (3) | $R_1 = C_{18}H_{37}$<br>$R_2 = R_3 = CH_3$<br>R4 = benzyl | $\frac{1}{3}(PW_{12}O_{40})^{3-}$ |
| (4) | $R_1 = R_2 = R_3 = C_4H_9$<br>$R_4$ = p-methylbenzyl | 1/2(1,5-naphthalene-disulfonic acid ion) |
| (5) | $R_1 = R_2 = CH_3$<br>$R_3 = R_4$ = p-methylbenzyl | 1/2(1,5-naphthalene-disulfonic acid ion) |
| (6) | $R_1 = R_2 = R_3 = C_4H_9$<br>R4 = benzyl | 1-naphthol-4-sulfonic acid ion |
| (7) | $R_1 = R_2 = R_3 = C_8H_{17}$<br>$R_4 = CH_3$ | 6-anilino-1-naphthol-3-sulfonic acid ion |
| (8) | $R_1 = R_2 = R_3 = C_{12}H_{25}$<br>$R_4 = CH_3$ | 6-anilino-1-naphthol-3-sulfonic acid ion |
| (9) | $R_1 = C_{18}H_{37}$<br>$R_2 = R_3 = CH_3$<br>R4 = benzyl | $Cl^-$ |

Exemplary compounds (continued)

| Compound No. | R | X |
|---|---|---|
| (10) | $R_1 = C_{12}H_{25}$<br>$R_2 = R_3 = CH_3$<br>R4 = benzyl | ½(1,5-napthalene-disulfonic acid ion) |
| (11) | $R_1 = C_{14}H_{29}$<br>$R_2 = R_3 = CH_3$<br>R4 = benzyl | ½(1,5-naphthalene-disulfonic acid ion) |
| (12) | $R_1 = C_{18}H_{37}$<br>$R_2 = R_3 = CH_3$<br>R4 = benzyl | ½(1,5-napthalene-disulfonic acid ion) |
| (13) | $R_1 = R_2 = C_{18}H_{37}$<br>$R_3 = R_4 = CH_3$ | ½(1,5-naphthalene-disulfonic acid ion) |
| (14) | $R_1 = R_2$ $CH_3$<br>$R_3 = R_4$ = p-tert-butylbenzyl | ½(1,5-naphthalene disulfonic acid ion) |
| (15) | $R_1 = R_2 = CH_3$<br>$R_3$ = benzyl<br>$R_4$ = p-tert-butylbenzyl | ½(1,5-naphthalene-disulfonic acid ion) |
| (16) | $R_1 = R_2 = CH_3$<br>$R_3$ = benzyl<br>$R_4$ = p-methylbenzyl | ½(1,5-naphthalene-disulfonic acid ion) |
| (17) | $R_1 = R_2 = CH_3$<br>$R_3 = R_4$ = benzyl | ½(1,5-naphthalene-disulfonic acid ion) |

Exemplary compounds (continued)

| Compound No. | R | X |
|---|---|---|
| (18) | $R_1 = C_8H_{17}$<br>$R_2 = R_3 = CH_3$<br>R4 = benzyl | ½(1,5-naphthalene-disulfonic acid ion) |
| (19) | $R_1 = R_2 = R_3 = C_8H_{17}$<br>$R4 = CH_3$ | ½(1,5-naphthalene-disulfonic acid ion) |
| (20) | $R_1 = R_2 = R_3 = C_{12}H_{25}$<br>$R4 = CH_3$ | ½(1,5-naphthalene-) disulfonic acid ion) |
| (21) | $R_1 = R_2 = R_3 = C_8H_{17}$<br>R4 = benzyl) | ½(1,5-naphthalne-disulfonic acid ion) |
| (22) | $R_1 = R_2 = R_3 = C_6H_{13}$<br>R4 = benzyl | ½(1,5-naphthalene-disulfonic acid ion) |

In the present invention, the quaternary ammonium salt is contained in an amount of preferably 0.1–10 parts, more preferably 0.5–5 parts by weight based on 100 parts by weight of the binder resin.

In the present invention, a magnetite carrier and a ferrite carrier may be used in admixture but preferably they are used severally.

As ferrite carrier in the present invention, all of those known in the art can be known, the typical examples thereof being $CuOFe_2O_3ZnO$ and $NiOFe_2O_3ZnO$. The surfaces of magnetite or ferrite carrier may be coated with a resin or the like. The coating resins usable here include, but are not limited to, fluorine-based polymers such as polyvinylidene fluoride, polytetrafluoroethylene, vinylidenefluoride-hexafluoropropylene copolymer, vinylidenefluoride-trifluoroethylene copolymer, etc., silicone resins, styrene-acrylic copolymer and the like. The carrier particle surfaces may be coated with a metal oxide. The carrier particle size is usually 50–300 $\mu$m.

By using the developer of the present invention, a stabilized toner charge can be attained, making it possible to obtain high-quality images without causing reduction of image density and change of quality such as increase of fog in a continuous copying operation.

EXAMPLES

The present invention is further illustrated by the following examples, which examples are however presented for the illustrative purpose only and not intended to be restrictive to the scope of the invention. In the following Examples, all "parts" are by weight unless otherwise noted.

Example 1

One hundred parts of a crosslinked type styrene/n-butyl acrylate resin (monomer ratio: 80/20 by weight; tetrahydrofuran-insoluble matter: 30% by weight; molecular weight distribution of soluble matter has peaks at $7.0\times10^3$ and $2.0\times10^5$; weight average molecular weight: $8\times10^4$), 5 parts of distearyl ketone (DSC determined endothermic peak: 87.5° C.; half value width: 6° C.), 3 parts of a polyalkylene wax (VISCOL 550P available from Sanyo Chemical Industries Ltd.), 6 parts of carbon black (#30 available from Mitsubishi Chemical Corporation) and 2 parts of a nigrosine dye (BONTRON N-04 available from Orient Chemical Industries Ltd.) were mixed and dispersed, and then melt kneaded by a twin-screw extruder. After cooled, the mixture was roughly crushed by a hammer mill and then finely crushed by an ultrasonic jet mill. The resulting powder was classified by an air classifier to obtain a toner A having an average particle diameter of 10.3 $\mu$m. Using this toner, the following tests were conducted.

Fixation test

A paper sheet carrying the unfixed toner was passed between the fixing rollers at a speed of 400 mm/sec, and the lower limit temperature at which fixation could be effected and the temperature which caused hot off-setting were examined. In the present examples, it is desirable that the lower limit temperature of fixation is not higher than 150° C., and that the temperature causing hot off-setting is not lower than 216° C.

Post-rubbing retention test

A rubbing test was conducted after passing the paper sheets carrying various amounts of unfixed toner between the fixing rollers at a speed of 400 mm/sec at 135° C. The post-rubbing retention was determined from the following equation, and the minimal value thereof was defined as the lowest post-rubbing retention.

In the present examples, it is desirable that the post-rubbing retention is not less than 50%.

Anti-blocking test

A predetermined load was applied to the toner, and after leaving the loaded toner under an environment of 50° C. for 5 hours, it was visually examined whether there occurred aggregation of the toner particles or not to evaluate the anti-blocking property.

In the present examples, it is desirable that the toner cause no aggregation of the particles.

Example 2

The procedure of Example 1 was followed except that the crosslinked type styrene/n-butyl acrylate resin was replaced by a non-crosslinked type styrene/stearyl acrylate resin (the molecular weight distribution has two peaks, the peak on the lower molecular weight side being at 4,500 and the peak on the higher molecular weight side being at $6.5\times10^5$; the weight ratio of lower molecular weight part/higher molecular weight part: 75/25; weight average molecular weight: $1.7\times10^5$) to produce a toner B and the properties thereof were evaluated in the same manner as in Example 1.

Example 3

The procedure of Example 1 was followed except that distearyl ketone was replaced by distearyl sebacate (DSC determined endothermic peak: 70.5° C.; half value width: 60° C.) to produce a toner C and the properties thereof were evaluated in the same manner as in Example 1.

Example 4

The procedure of Example 1 was followed except that distearyl ketone was replaced by UNISTAR M-2222SL available from NOF Corporation (behenyl behenate; DSC determined endothermic peak: 76.0° C.; half value width: 8° C.) to produce a toner D and the properties thereof were evaluated in the same manner as in Example 1.

Example 5

The procedure of Example 1 was followed except that distearyl ketone was replaced by Kawa-Wax L(G) available from Kawaken Fine Chemical Co., Ltd. (basically composed of myricyl lignocerate; DSC determined endothermic peak: 86° C.; half value width: 5° C.) to produce a toner E and the properties thereof were evaluated in the same manner as in Example 1.

Example 6

Seventy parts of a polystyrene having a peak of molecular weight at 5,000, 30 parts of a styrene/stearyl acrylate (monomer ratio: 90/10 by weight) copolymer having a peak of molecular weight at $7.5\times10^5$ (weight average molecular weight: $2.3\times10^5$) and 5 parts of KAO-WAX T-1 available from KAO Corporation (distearyl ketone; DSC determined endothermic peak: 87.5° C.; half value width: 8° C.) were dissolved in tetrahydrofuran and poured into water. The precipitate was recovered by decantation and vacuum-dried at 60° C. to obtain a resin composition. The procedure of Example 1 was followed except that the resin composition was used to produce a toner F and the properties thereof were evaluated in the same manner as in Example 1.

Example 7

Seventy five parts of styrene was polymerized in xylene using benzoic peroxide as a polymerization initiator to obtain a styrene homopolymer having a peak of molecular weight at 8,000. To this polymer solution, 5 parts of behenyl behenate (DSC determined endothermic peak: 76.0° C.; half value width: 8° C.) and 25 parts of an emulsion polymerized styrene/n-butyl acrylate (monomer ratio: 80/20) copolymer having a peak of molecular weight at $6.5\times10^5$ were added and perfectly dissolved. Then xylene was evaporated away to obtain a styrene-based resin (weight average molecular weight: $1.7\times10^5$) having a lubricant uniformly dissolved therein (a resin composition), and it was roughly crushed to a particle size of about 0.5 mm. The procedure of Example 1 was followed except that the resin composition was used to produce a toner G and the properties thereof were evaluated in the same manner as in Example 1.

Comparative Example 1

The procedure of Example 1 was followed except that no distearyl ketone was added to produce a toner H and the properties thereof were evaluated in the same manner as in Example 1.

Comparative Example 2

The procedure of Example 1 was followed except that distearyl ketone was replaced by a lubricant (ethylenebisstearic acid amide) having a DSC determined endothermic peak at 141.5° C. and a half value width of 10° C. to produce a toner I and the properties thereof were evaluated in the same manner as in Example 1.

Comparative Example 3

The procedure of Example 1 was followed except that distearyl ketone was replaced by a lubricant (cured castor oil) having a DSC determined endothermic peak at 85.0° C. and a half value width of 24.8° C. to produce a toner J and the properties thereof were evaluated in the same manner as in Example 1.

Comparative Example 4

The procedure of Example 1 was followed except that distearyl ketone was replaced by a lubricant (low-molecular weight polyethylene) having a DSC determined endothermic peak at 135.0° C. and a half value width of 11.0° C. to produce a toner K and the properties thereof were evaluated in the same manner as in Example 1.

The test results on the toners of Examples 1–7 and Comparative Examples 1–4 are shown in Table 1.

TABLE 1

| No. | Toner No. | Tg of binder (°C.) | Lower limit temperature for fixation (°C.) | Hot off-setting inducing temperature |
|---|---|---|---|---|
| Example 1 | A | 62 | 145 | not less than 220° C. |
| Example 2 | B | 61 | 140 | not less than 220° C. |
| Example 3 | C | 62 | 145 | not less than 220° C. |
| Example 4 | D | 62 | 145 | not less than 220° C. |
| Example 5 | E | 62 | 140 | not less than 220° C. |
| Example 6 | F | 60 | 140 | not less than 220° C. |
| Example 7 | G | 62 | 140 | not less than 220° C. |
| Comparative Example 1 | H | 62 | 155 | not less than 220° C. |
| Comparative Example 2 | I | 62 | 155 | not less than 220° C. |
| Comparative Example 3 | J | 62 | 145 | 215° C. |
| Comparative Example 4 | K | 62 | 155 | not less than 220° C. |

| No. | Lowest post-rubbing retention | Toner Anti-blocking properties (Note) |
|---|---|---|
| Example 1 | 70.3 | ○ |
| Example 2 | 79.2 | ○ |
| Example 3 | 65.9 | ○ |
| Example 4 | 50.9 | ○ |
| Example 5 | 70.0 | ○ |
| Example 6 | 75.3 | ○ |
| Example 7 | 55.0 | ○ |
| Comparative Example 1 | 31.2 | ○ |
| Comparative Example 2 | 33.4 | ○ |
| Comparative Example 3 | 49.9 | x |
| Comparative Example 4 | 31.2 | ○ |

(Note) Anti-blocking property:
○: No aggregation of toner particles.
x: Aggreation of toner particles.

As is seen from Table 1, the toner according to the present invention is excellent in fixation characteristics (low-temperature fixation property and fixation strength), anti-off-setting property and anti-blocking property.

Example 8

One hundred parts of a non-crosslinked type styrene/butyl acrylate resin (the molecular weight distribution has two peaks, the peak on the lower molecular weight side being at 4,500 and the peak on the higher molecular weight side being at $4.0\times10^5$; the weight ratio of lower molecular weight part/higher molecular weight part: 60/40; weight average molecular weight: $1.8\times10^5$), 5 parts of distearyl ketone (mp: 88° C.) as lubricant, 3 parts of a polyalkylene wax (VISCOL 550P available from Sanyo Chemical Industries Ltd.), 6 parts of carbon black (#30 available from Mitsubishi Chemical Corporation) and 2 parts of a nigrosine dye (BONTRON N-04 available from Orient Chemical Industries Ltd.) were mixed and dispersed, and then melt kneaded by a twin-screw extruder. After cooled, the mixture was roughly crushed by a hammer mill and finely crushed by an ultrasonic jet mill. The resulting powder was classified by an air classifier to obtain a toner L having an average particle diameter of 10.3 μm and the properties thereof were evaluated in the same manner as in Example 1.

Example 9

The procedure of Example 8 was followed except that distearyl ketone was replaced by distearyl sebacate (mp: 71° C.) to produce a toner M and the properties thereof were evaluated in the same manner as in Example 1.

Example 10

The procedure of Example 8 was followed except that distearyl ketone was replaced by behenyl behenate (mp: 76° C.) to produce a toner N and the properties thereof were evaluated in the same manner as in Example 1.

Example 11

The procedure of Example 8 was followed except that the binder resin was replaced by a uniform mixture of 70 parts of a polystyrene whose molecular weight distribution has a peak at 5,000 and 30 parts of a styrene/stearyl acrylate (monomer ratio: 90/10 by weight) copolymer having a peak of molecular weight at $7.5\times10^5$ to produce a toner O and the properties thereof were evaluated in the same manner as in Example 1.

Comparative Example 5

The procedure of Example 8 was followed except that no distearyl ketone was added to produce a toner P and the properties thereof were evaluated in the same manner as in Example 1.

Comparative Example 6

The procedure of Example 8 was followed except that distearyl ketone was replaced by butyl stearate to produce a toner Q and the properties thereof were evaluated in the same manner as in Example 1.

Comparative Example 7

The procedure of Example 8 was followed except that distearyl ketone was replaced by mannitol to produce a toner R and the properties thereof were evaluated in the same manner as in Example 1.

The test results on the toners of Examples 8–11 and Comparative Examples 5–7 are shown in Table 2.

TABLE 2

| No. | Toner No. | Tg of binder (°C.) | Melting point of lubricant (°C.) | Molecular weight of lubricant | Half value width of lubricant (°C.) |
|---|---|---|---|---|---|
| Example 8 | L | 60 | 88 | 534 | 6 |
| Example 9 | M | 60 | 71 | 706 | 6 |
| Example 10 | N | 60 | 76 | 648 | 7 |
| Example 11 | O | 58 | 88 | 534 | 6 |
| Comparative Example 5 | P | 60 | — | — | 6 |
| Comparative Example 6 | Q | 60 | 24 | 354 | 6 |
| Comparative Example 7 | R | 60 | 166 | 182 | 6 |

| No. | Lower limit temperature for fixation (°C.) | Hot off-setting inducing temperature (°C.) | Lowest post-rubbing retention | Anti-blocking property (Note) |
|---|---|---|---|---|
| Example 8 | 145 | not less than 220 | 78.0 | ○ |
| Example 9 | 140 | not less than 220 | 70.1 | ○ |
| Example 10 | 145 | not less than 220 | 51.1 | ○ |
| Example 11 | 140 | not less than 220 | 79.8 | ○ |
| Comparative Example 5 | 155 | not less than 220 | 31.1 | ○ |
| Comparative Example 6 | 145 | not less than 220 | 60.3 | x |
| Comparative Example 7 | 165 | not les than 220 | 30.0 | ○ |

(Note) Anti-blocking property:
○: No aggreation of toner articles.
x: Aggreation of toner particles.

As is seen from Table 2, the toner according to the present invention is excellent in fixing characteristics (low-temperature fixing properties and fixing strength), anti-off-setting properties and anti-blocking property.

Example 12

One hundred parts of a crosslinked type styrene/n-butyl acrylate resin (monomer ratio: 80/20 by weight; tetrahydrofuran-insoluble matter: 30% by weight; molecular weight distribution of soluble matter has peaks at $1.0\times10^4$ and $2\times10^5$; weight average molecular weight: $8.0\times10^4$), 5 parts of di-n-stearyl ketone (DSC determined endothermic peak: 87.5° C.; half value width: 6° C.), 3 parts of VISCOL 550P (available from Sanyo Chemical Industries Ltd.), 6 parts of carbon black (#30 available from Mitsubishi Chemical Corporation) and 2 parts of a quaternary ammonium salt (Exemplary compound No. 6) were mixed and dispersed, and then melt kneaded by a twin-screw extruder. After cooled, the mixture was roughly crushed by a hammer mill and finely crushed by an ultrasonic jet mill. The resulting powder was classified by an air classifier to produce a toner having an average particle diameter of 10.3 $\mu$m. Five parts of this toner was mixed with 100 parts of a ferrite carrier (FL96-100 available from POWDERTECH Co., Ltd.) by a V type mixer to produce a developer A.

Example 13

The procedure of Example 12 was followed except that the crosslinked type styrene/n-butyl acrylate resin was replaced by a styrene/n-butyl accrylate resin (monomer ratio: 80/20 by weight; molecular weight distribution has peaks at $4.5\times10^3$ and $6.5\times10^5$) to produce a developer B.

Example 14

The procedure of Example 12 was followed except that di-n-stearyl ketone was replaced by distearyl sebacate (DSC determined endothermic peak: 70.5° C.; half value width: 6° C.) to produce a developer C.

Example 15

The procedure of Example 14 was followed except that the crosslinked type styrene/n-butyl acrylate resin was replaced by the styrene/n-butyl acrylate resin employed in Example 13 to produce a developer D.

Example 16

The procedure of Example 12 was followed except that di-n-stearyl ketone was replaced by behenyl behenate (DSC determined endothermic peak: 76.0° C.; half value width: 8° C.) to produce a developer E.

Example 17

The procedure of Example 12 was followed except that the quaternary ammonium salt of Exemplary compound No. 6 was replaced by a quaternary ammonium salt of Exemplary compound No. 4 to produce a developer F.

Example 18

The procedure of Example 12 was followed except that the ferrite carrier was replaced by a silicone resin-coated magnetite carrier to produce a developer G.

Comparative Example 8

The procedure of Example 12 was followed except that di-n-stearyl ketone was replaced by cured castor oil (DSC determined endothermic peak: 85.0° C.; half value width: 24.8° C.) to produce a developer I.

Comparative Example 9

The procedure of Example 12 was followed except that di-n-stearyl ketone was replaced by low-molecular weight polyethylene (DSC determined endothermic peak: 135.0° C.; half value width: 11.0° C.) to produce a developer J.

Comparative Example 10

The procedure of Example 12 was followed except that di-n-stearyl ketone was replaced by ethylenebisstearic acid amide (DSC determined endothermic peak: 141.5° C.; half value width: 10.1° C.) to produce a developer K.

The weight-average molecular weight (Mw) and glass transition temperature (Tg) of the binder resins used in Examples 12 and 13 are as follows:

| | Mw | Tg (°C.) |
|---|---|---|
| Example 12 | $8.0 \times 10^4$ | 62 |
| Example 13 | $1.7 \times 10^5$ | 61 |

Using the above developers A–K and a copier SF-9700 (mfd. by SHARP Corporation), a continuous copying test was carried out to examine the change of image density (I.D.) and fogging factor. An image densitometer RD-917 (mfd. by Macbeth) was used for the measurement of image density, and Z-II Optical Sensor (mfd. by Nippon Denshoku Kogyo Co., Ltd.) was used for determination of fogging factor. The results are shown in Table 3.

In the present examples, it is desirable that fogging factor is not more than 0.8 and image density is not less than 1.3.

TABLE 3

| | Number of copies | | | |
|---|---|---|---|---|
| | Initial | | $1 \times 10^4$ | |
| Developer | I.D | Fog | I.D | Fog |
| Example A | 1.40 | 0.46 | 1.41 | 0.45 |
| Example B | 1.42 | 0.48 | 1.42 | 0.46 |
| Example C | 1.40 | 0.41 | 1.40 | 0.44 |
| Example D | 1.43 | 0.49 | 1.42 | 0.49 |
| Example E | 1.40 | 0.40 | 1.41 | 0.41 |
| Example F | 1.41 | 0.45 | 1.40 | 0.45 |
| Example G | 1.40 | 0.50 | 1.39 | 0.47 |
| Comp. H Example | 1.30 | 0.30 | 1.21 | 0.32 |
| Comp. I Example | 1.45 | 0.79 | 1.46 | 0.91 |
| Comp. J Example | 1.38 | 0.61 | 1.41 | 0.73 |
| Comp. K Example | 1.28 | 0.48 | 1.26 | 0.43 |

| | Number of copies | | | |
|---|---|---|---|---|
| | $1 \times 10^5$ | | $2 \times 10^4$ | |
| Developer | I.D | Fog | I.D | Fog |
| Example A | 1.42 | 0.48 | 1.41 | 0.47 |
| Example B | 1.41 | 0.44 | 1.41 | 0.45 |
| Example C | 1.40 | 0.43 | 1.41 | 0.45 |
| Example D | 1.42 | 0.46 | 1.41 | 0.46 |
| Example E | 1.41 | 0.40 | 1.42 | 0.43 |
| Example F | 1.43 | 0.43 | 1.42 | 0.43 |
| Eaxmple G | 1.41 | 0.48 | 1.41 | 0.48 |
| Comp. H Eaxmple | 1.19 | 0.32 | 1.08 | 0.31 |
| Comp. I Example | 1.48 | 1.01 | 1.50 | 1.01 |
| Comp. J Example | 1.45 | 0.96 | 1.48 | 0.99 |
| Comp. K Example | 1.11 | 0.41 | 1.05 | 0.40 |

As is seen from Table 3, the developer according to the present invention has very high performance and causes little change of fog and image density even when used continuously for forming 200,000 copies.

What is claimed is:

1. A toner for electrostatic image development comprising:

a lubricant, a binder resin, and a coloring agent, wherein said lubricant has a DSC determined endothermic peak at 50°–130° C., with the half value width of said endothermic peak being not more than 15° C., and is represented by the formula (I)

$$R^1-\underset{\underset{O}{\|}}{C}-R^2 \qquad (I)$$

wherein $R^1$ represents an alkoxyl group having 16 or more carbon atoms, and $R^2$ represents a group represented by —X—COOR$^3$ wherein X represents an alkylene group and $R^3$ represents an alkyl group having 10 or more carbon atoms; and said binder resin comprises a resin which contains 30% or more by weight of structure units of styrene or styrene derivatives, tetrahydrofuran soluble matter of said resin has the weight-average molecular weight of not less than 50,000, and has one or more peaks of molecular weight in both the range of not more than $5\times10^4$, and the range of $1\times10^5$ to $1\times10^7$, respectively, on the gel permeation chromatogram.

2. The toner of claim 1, wherein the lubricant comprises an aliphatic ketone, a fatty acid monoester or a fatty acid diester.

3. The toner of claim 1, wherein the molecular weight of the lubricant is 200 to 1,000.

4. The toner of claim 1, wherein said resin is a styrene homopolymer, a styrene-acrylic ester copolymer, a styrene-methacrylic ester copolymer or a mixture thereof.

5. The toner of claim 1, wherein the content of the lubricant is 0.5 to 30 parts by weight based on 100 parts by weight of the binder resin.

6. The toner of claim 1, wherein X represents $$\text{-}(CH_2)_n\text{-}$$

wherein n is a number of 6 or more.

7. The toner of claim 1, wherein the glass transition temperature (Tg) of the binder resin is 50° to 70° C. and the melting point (mp) of the lubricant is $Tg \leqq mp \leqq Tg+50°$ C.

8. The developer comprising a toner of claim 1 further containing a quaternary ammonium salt and a ferrite carrier or a magnetite carrier.

9. The developer of claim 8, wherein the content of the quaternary ammonium salt is 0.1 to 10 parts by weight based on 100 parts by weight of the binder resin.

10. The developer of claim 8, wherein the quaternary ammonium salt is an acyclic quaternary ammonium salt, an imidazolium salt, a pyridinium salt, a 3H-inodolium salt, a phenadium salt, a triethylenebisammonium salt or a nitrotriethylammonium salt.

11. The developer of claim 8, wherein the amount of the carrier is 10 to 100 parts by weight based on one part by weight of the toner.

12. A toner for electrostatic image development comprising:

a lubricant, a binder resin, and a coloring agent, wherein said lubricant has a DSC determined endothermic peak at 50°–130° C., with the half value width of said endothermic peak being not more than 15° C., and is selected from the group consisting of di-n-decyl ketone, di-n-dodecyl ketone, di-n-stearyl ketone, di-n-icosyl ketone, di-n-behenyl ketone, di-n-tetracosyl ketone, distearyl sebacate, dibehenyl sebacate, stearyl laurate, behenyl laurate, stearyl stearate, behenyl stearate, myricyl stearate, stearyl behenate, behenyl behenate, myricyl behenate, stearyl lignocerate, behenyl lignocerate, and myricyl lignocerate; and said binder resin comprises a resin which contains 30% or more by weight of structure units of styrene or styrene derivatives, tetrahydrofuran soluble matter of said resin has the weight-average molecular weight of not less than 50,000, and has one or more peaks of molecular weight in both the range of not more than $5\times10^4$, and the range of $1\times10^5$ to $1\times10^7$, respectively, on the gel permeation chromatogram.

13. A toner for electrostatic image development comprising:

a lubricant, a binder resin, and a coloring agent, wherein said lubricant has a DSC determined endothermic peak at 50°–130° C., with the half value width of said endothermic peak being not more than 15° C., and is represented by the formula (I)

$$R^1-\underset{\underset{O}{\|}}{C}-R^2 \qquad (I)$$

wherein $R^1$ is selected from the group consisting of decyl, dodecyl, stearyl, icosyl, behenyl, tetracosyl, stearyloxyl, behenyloxyl and myricyloxyl, and $R^2$ represents a group represented by —X—$COOR^3$ wherein X represents an alkylene group and $R^3$ represents an alkyl group having 10 or more carbon atoms; and said binder resin comprises a resin which contains 30% or more by weight of structure units of styrene or styrene derivatives, tetrahydrofuran soluble matter of said resin has the weight-average molecular weight of not less than 50,000, and has one or more peaks of molecular weight in both the range of not more than $5\times10^4$, and the range of $1\times10^5$ to $1\times10^7$, respectively, on the gel permeation chromatogram.

* * * * *